US006994185B1

(12) United States Patent
Hertel

(10) Patent No.: US 6,994,185 B1
(45) Date of Patent: Feb. 7, 2006

(54) LADDER RUNG PAD ASSEMBLY

(76) Inventor: Ryan W. Hertel, 2605 Jere La., Arnold, MO (US) 63010

( * ) Notice: Subject to any disclaimer, the term of this patent is extended or adjusted under 35 U.S.C. 154(b) by 0 days.

(21) Appl. No.: 11/019,773

(22) Filed: Dec. 23, 2004

(51) Int. Cl.
*E06C 7/00* (2006.01)

(52) U.S. Cl. ..... 182/129

(58) Field of Classification Search ..... 182/129; 248/345.1
See application file for complete search history.

(56) References Cited

U.S. PATENT DOCUMENTS 2,518,107 A 8/1950 Wilson
3,144,236 A * 8/1964 Clanin ..... 150/154
4,109,887 A * 8/1978 Wakeland, Jr. ..... 5/678
4,197,342 A * 4/1980 Bethe ..... 428/159
5,058,789 A 10/1991 Piper
5,333,933 A * 8/1994 Urai et al. ..... 297/452.1
5,370,204 A 12/1994 Fox
D372,989 S 8/1996 Gile et al.
5,692,581 A 12/1997 Nelson
5,816,365 A 10/1998 Ruth

* cited by examiner

*Primary Examiner*—Alvin Chin-Shue

(57) ABSTRACT

A ladder rung pad assembly for providing a selectively positionable pad for attaching to a rung of a ladder adjacent to a shin or other part of the body that typically rests against the ladder rung while the user stands on the ladder. The ladder ring pad assembly includes a plastic clip member having a pair of resilient arms for gripping a ladder rung. An exterior surface of the clip member is covered by a pad member. The pad member is optionally covered by a cover member. Each of the resilient arms has a distal hook portion to facilitate coupling the clip member to the ladder rung.

5 Claims, 2 Drawing Sheets

LADDER RUNG PAD ASSEMBLY

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to ladder pad devices and, more particularly, to a new ladder rung pad assembly for providing a selectively positionable pad for attaching to a rung of a ladder adjacent to a shin or other part of the body that typically rests against the ladder rung while the user stands on the ladder.

2. Prior Art

The use of padding devices for ladders is known in the prior art. More specifically, padding devices for ladders heretofore devised and utilized are known to consist basically of familiar, expected and obvious structural configurations, notwithstanding the myriad of designs encompassed by the crowded prior art which have been developed for the fulfillment of countless objectives and requirements.

Extension ladders and other types of ladders are notoriously difficult to carry from place to place, both because of their weight (up to 50 pounds) and because their length makes them awkward and cumbersome to handle. Aggravating this problem is the fact that the ladder is often needed in places that are rather inaccessible, and it is not uncommon for rough and/or hilly terrain to be encountered when carrying the ladder to and from its point of use.

Perhaps the most common technique used in carrying an extension ladder is to balance it on the shoulder and to then walk slowly and carefully to the desired location. Although this technique is better than others in many respects, it is not wholly satisfactory and can result in physical injuries. Probably the most notable problem is that the entire weight of the ladder is concentrated on the shoulder and is borne by the clavicle and surrounding tissue.

Consequently, there is not only considerable discomfort to the shoulder area, but there is also a high incidence of physical injury to the shoulder, neck, back and arm areas, as well as aggravation of prior injuries to these areas. Properly balancing a lengthy ladder of the narrow fulcrum provided by the shoulder creates instability that can result in accidents. Additionally, the person carrying the ladder is likely to tire quickly and to devote more attention to enduring upper body discomfort and the unbalanced condition of the ladder than to walking carefully, thus increasing the chances of stumbling or another accident. Although there are padding devices that assist a user in carrying a ladder with less discomfort, none of these provide padding protection to other body parts, such as shins and knees, once the user is situated on the ladder.

Accordingly, a need remains for a new ladder rung pad assembly in order to overcome the above-noted shortcomings. The present invention satisfies such a need by providing a ladder rung pad that is simple and novel in design, easy to use, reasonably priced, and improves safety and comfort levels. Such a pad assembly advantageously minimizes shin and knee injuries which allows worker to do their work more comfortably and productively. Conveniently the ladder rung pad assembly can be utilized by a wide variety of trdes people along with do-it-yourself enthusiasts.

BRIEF SUMMARY OF THE INVENTION

In view of the foregoing background, it is therefore an object of the present invention to provide a ladder rung pad assembly. These and other objects, features, and advantages of the invention are provided by a ladder rung pad assembly for providing user comfort and protection.

The ladder rung assembly includes a clip member that has a pair of resilient arms forming a generally V-shape cross-section. Such a clip member preferably has a uniform cross-section along a length of the cross member. Each of the arms has a distal hook portion whereby the clip member is conveniently adapted for coupling to a ladder rung of a ladder.

A pad member is coupled to an exterior surface of the clip member such that the pad member covers the rung of the ladder. Preferably, a full area of an interior surface of the pad member is affixed to the exterior surface of the clip member. The ladder rung pad assembly may further include a cover member coupled to the pad member to effectively cover an exterior surface of the pad member. Such a cover member is stitched to the pad member. The stitching forms a pair of stitch panels, wherein each of the stitch panels is positioned on an associated face of the pad member.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
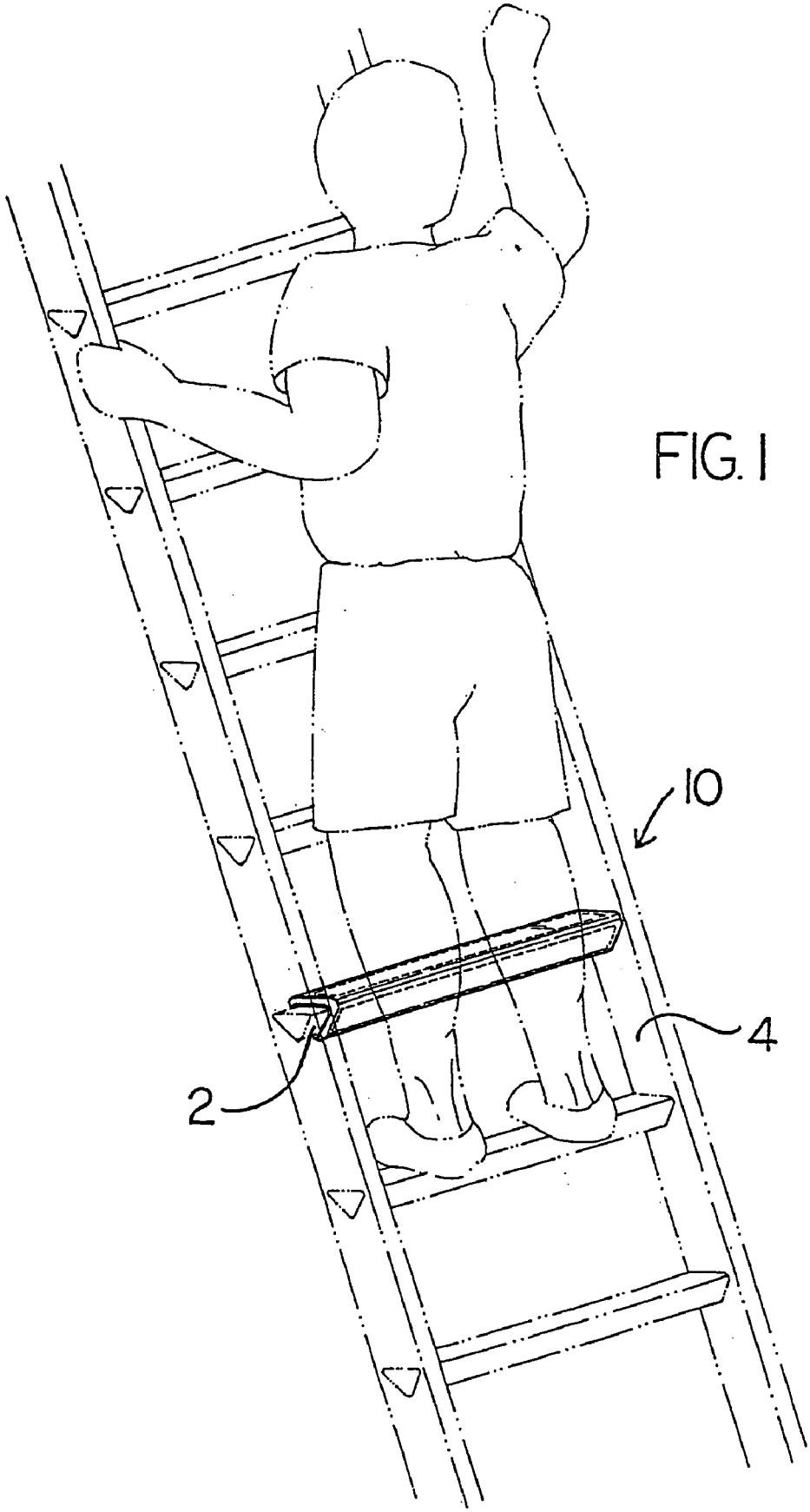
FIG. 1 is a perspective view showing a ladder rung pad assembly, in accordance with the present invention.
Figure 2:
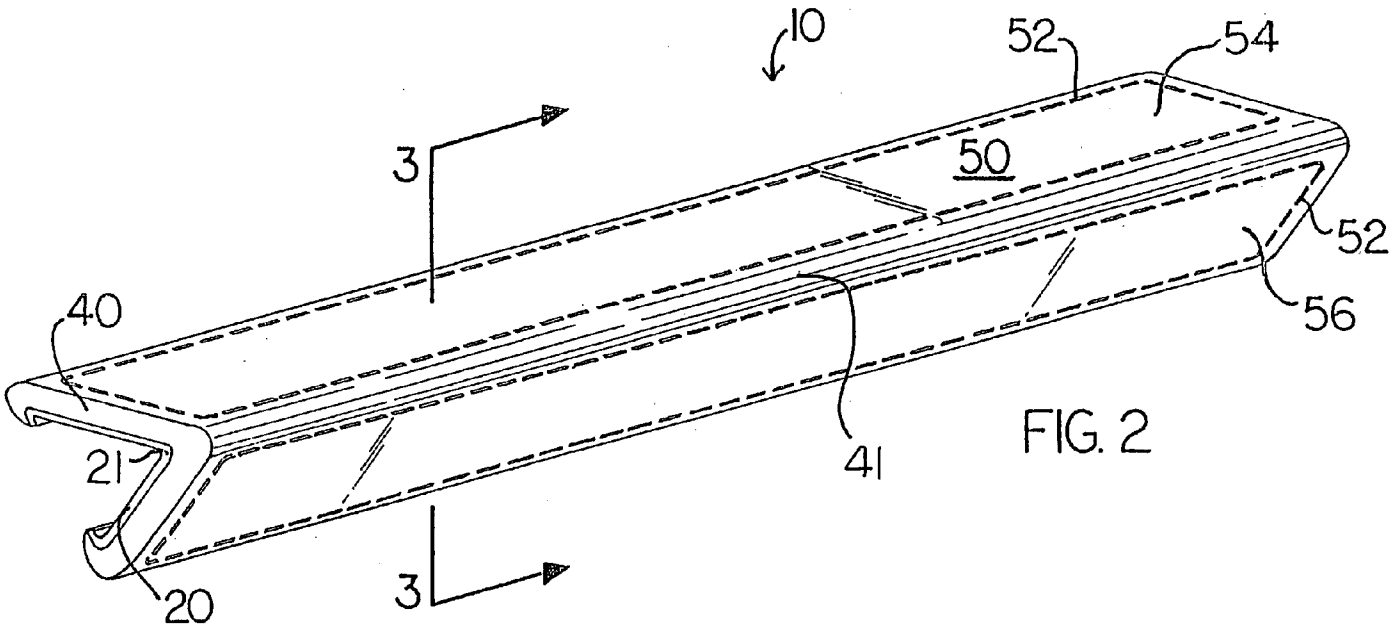
FIG. 2 is an enlarged perspective view of the assembly shown in FIG. 1.
Figure 3:
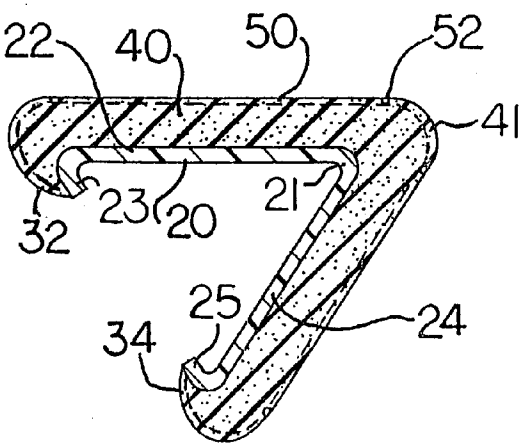
FIG. 3 is a cross-sectional view of the assembly shown in FIG. 2, taken along line 3—3.

The assembly of this invention is referred to generally in FIGS. 1–3 by the reference numeral 10 and is intended to provide a ladder rung pad assembly. It should be understood that the assembly 10 may be used to protect many different types of structures and should not be limited to only ladder rungs.

Referring to FIGS. 1 through 3, the ladder rung pad assembly 10 generally includes a clip member 20 that includes a pair of resilient arms 22 and 24 forming a generally V-shaped cross-section. Each of the arms 22, 24 includes a distal hoop portion 32, 34 respectively. Thus, the clip member 20 is designed for coupling to a ladder rung 2. Typically, ladder rungs are now generally triangular in shape and the distance between a junction of the resilient arms 22, 24 and the distal hook portions 32, 34 are sized to correspond to a width of the ladder rung faces to insure a tight and secure fit. However, the resilience of the arms and the distal hoop portions permit attachment to rectangular rungs as well.

A pad member 40 is coupled to an exterior surface of the clip member 20 such that the pad member 40 covers the rung 2 of the ladder 4. Of course, such a pad member may be formed from conventional resilient material such a foam material, well known in the industry. The thickness of the pad member 40 may be adjusted to accommodate various applications in both the construction and residential industries.

In one embodiment, the clip member 20 includes a uniform cross-section along a length of the clip member 20 to facilitate economic manufacturing of the clip member 20. Preferably, a full area of an interior surface of the pad member 40 is affixed to the exterior surface of the clip member 20. Clip member 20 may be formed from rigid material such as hardened plastic for providing a stable contact surface between pad member 40 and the ladder rung 2. Both the pad member 40 and clip member 20 have elongated edge portions 41, 21 extending substantially parallel to each other and defining a pair of fulcrum axes about which the assembly 10 can be resiliently articulated. Clip member 20 further has a pair of opposed distal loop portions 23, 25 which bend along loop portions 32, 34, respectively, for maintaining pad member 40 at a fixed relationship when positioned about the ladder rung 2.

In an alternate embodiment, assembly 10 further includes a cover member 50 coupled to the pad member 40 to cover an exterior surface of the pad member 40. Typically, the cover member 50 is stitched to the pad member 40. Stitching 52 forms a pair of stitch panels 54 and 56, each being positioned on an associated face of the pad member arms 22, 24. Of course, cover member 50 is preferably formed from water-impermeable material that also provides a non-skid surface onto which a user may stand.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A ladder rung pad assembly engaged with a ladder rung comprising:

a clip member having a pair of coextensively shaped resilient arms forming a generally V-shape cross-section and having a monolithically formed elbow portion medially formed therebetween and linearly extending along a longitudinal length of said clip member, each of said arms having a distal end portion defining a maximum distance from said elbow, each of said distal end portions having monolithically formed distal hook portions equidistantly spaced from said ridge, said distal hook portions being coextensively shaped and facing inwardly towards each other each of said arms having inner planar top and bottom surface, said top and bottom surfaces directly confronting a rise and a tread of a ladder rung wherein said elbow is disposed proximal to a user while said distal end portions are disposed distal to the user after said clip member is positioned about the ladder rung; and a pad member directly coupled to an exterior surface of said clip member such that said pad member covers the rung of the ladder, said pad member having oppositely facing beveled edge directly contacting said distal hook portions and wrapping thereabout.

2. The ladder rung pad assembly of claim 1, wherein said clip member has a uniform cross-section along a length of said clip member.

3. The ladder rung pad assembly of claim 1, further comprising:

a cover member coupled to said pad member to cover an exterior surface of said pad member.

4. The ladder rung pad assembly of claim 3, wherein said cover member is stitched to said pad member, said stitching forming a pair of stitch panels, each of said stitch panels being positioned on an associated face of said pad member.

5. The ladder rung pad assembly of claim 1, wherein a full area of an interior surface of said pad member is affixed to said exterior surface of said clip member.

* * * * *